US006515232B2

(12) United States Patent
Forster

(10) Patent No.: US 6,515,232 B2
(45) Date of Patent: Feb. 4, 2003

(54) HIGH VOLTAGE BUSHING AND METHOD OF ASSEMBLING SAME

(75) Inventor: Raymond L. Forster, Ballwin, MO (US)

(73) Assignee: Mechanical Dynamics & Analysis, LLC., Schenectady, NY (US)

( * ) Notice: Subject to any disclaimer, the term of this patent is extended or adjusted under 35 U.S.C. 154(b) by 0 days.

(21) Appl. No.: 10/016,873

(22) Filed: Dec. 14, 2001

(65) Prior Publication Data

US 2002/0074156 A1 Jun. 20, 2002

Related U.S. Application Data

(60) Provisional application No. 60/256,112, filed on Dec. 15, 2000.

(51) Int. Cl.[7] ..... H01B 17/26

(52) U.S. Cl. ..... 174/152 R; 174/31 R; 174/142; 174/167

(58) Field of Search ..... 174/14 BH, 31 R, 174/50.62, 142, 144, 151, 152 R, 153 R, 158 R, 167, 171

(56) References Cited

U.S. PATENT DOCUMENTS 3,708,612 A * 1/1973 Saxon et al. ..... 174/142
3,767,843 A * 10/1973 Stone ..... 174/142
3,784,733 A * 1/1974 Farmer et al. ..... 174/142
4,214,119 A * 7/1980 Keen, Jr. ..... 174/18
4,670,625 A * 6/1987 Wood et al. ..... 174/142
4,716,338 A * 12/1987 Rungz ..... 174/167
4,965,407 A * 10/1990 Hamm ..... 174/142
4,980,515 A * 12/1990 Sakuma et al ..... 174/18
5,091,605 A * 2/1992 Clifford ..... 174/151
5,374,789 A * 12/1994 Bernstorf ..... 174/169
5,483,023 A 1/1996 Barnes
6,150,613 A * 11/2000 Bergstrom ..... 174/152 R

* cited by examiner

*Primary Examiner*—Dean A. Reichard
*Assistant Examiner*—Adolfo Nino
(74) *Attorney, Agent, or Firm*—Heslin Rothenberg Farley & Mesiti P.C.

(57) ABSTRACT

A high voltage bushing comprising an insulator enclosing a conductor and a mounting flange slid over the insulator. The outer surface of the insulator defines a flange seat for contacting one end of the mounting flange. A gasket may be positioned on the flange seat between the insulator and mounting flange to form a gas tight seal to prevent the escape of hydrogen. A layer of epoxy attaches the remaining portion of the mounting flange to the insulator. The insulator of the high voltage bushing is made from a composite material rather than porcelain as is traditionally used, while a high temperature asphalt material is also used.

16 Claims, 3 Drawing Sheets

HIGH VOLTAGE BUSHING AND METHOD OF ASSEMBLING SAME

This application claims the benefit of Provisional application No. 60/256,112, filed Dec. 15, 2000.

FIELD OF THE INVENTION

This invention relates generally to the transmission of electrical current and voltage from an electrical generator to an electrical bus transmission system and, more particularly, to a high voltage bushing for use in transmitting the electrical current and voltage in the electric generator.

BACKGROUND OF THE INVENTION

A high voltage bushing is conventionally used for passing an electrical conductor through a pressure vessel wall of, for example, a large generator, without allowing hydrogen gas inside the pressure vessel to leak out of the vessel. The conductor is electrically insulated from the pressure vessel wall by a porcelain sleeve. An asphalt layer is positioned between the porcelain insulator and conductor to provide heat transfer from the conductor out to the porcelain insulator and then to the surrounding hydrogen and air-cooling mediums. However, current construction of conventional high voltage bushings does not adequately protect against the escape of hydrogen out of the pressure vessel or asphalt out of the bushing and is tedious and costly.

SUMMARY OF THE INVENTION

The shortcomings of the prior art may be alleviated by using a high voltage bushing in accordance with one or more principles of the present invention.

In one aspect of the invention, there is provided a high voltage bushing comprising an insulator adapted to fit over a conductor and a mounting flange mounted over the insulator. The insulator includes an outer surface defining a flange seat. The mounting flange includes an axial portion and a radial portion located at one end of the axial portion. The axial portion is positioned on the flange seat of the insulator at an end opposite of the radial portion, while the remaining portion of the axial portion joins the insulator by an adhesive layer. In one embodiment, a gasket may be positioned on the flange seat between the insulator and the mounting flange to aid in sealing against the escape of hydrogen.

In another aspect of the invention there is provided a method of assembling the high voltage bushing. The method comprises providing an insulator including an outer surface and defining a flange seat and a mounting flange including an axial portion and a radial portion located at one end of the axial portion. A gasket is positioned on the flange seat of the insulator and the mounting flange is slid onto the insulator until an end of the axial portion opposite the radial portion is positioned in the flange seat of the insulator over the gasket. An adhesive layer is inserted between the mounting flange and the insulator to connect the mounting flange to the insulator while the gasket is used as a dam to prevent leakage of the adhesive.

Additional advantages are provided through the provision of a high voltage bushing having an insulator made from a composite material and a high temperature asphalt material between the conductor and the insulator. The high voltage bushing and method of constructing the high voltage bushing described and claimed herein assures a more reliable gas tight seal between the insulator over the conductor and the mounting flange installed over the insulator to prevent escape of hydrogen from the generator. The gas tight seal is formed by a gasket positioned between the insulator and the mounting flange.

Another advantage of the present invention is the savings in cost and time in assembling the high voltage bushing in accordance with the principles of the present invention. For example, the mounting flange may contact a flange seat formed in the insulator which provides for quick flange installation, accurate flange alignment and reduced construction time of the bushing.

Additional features and advantages are realized through the techniques of the present invention. Other embodiments and aspects of the invention are described in detail herein and considered a part of the claimed invention.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DETAILED DESCRIPTION OF EMBODIMENTS OF THE INVENTION

Presented herein is an improved high voltage bushing which provides a more reliable seal preventing the escape of hydrogen from a generator during use. The enhanced high voltage bushing includes an insulator made from a composite material having better characteristics than the traditional porcelain material used in conventional high voltage bushings. The assembly method of the bushing provides cost and time savings and improves the reliability of the improved high voltage bushing.

Figure 3:
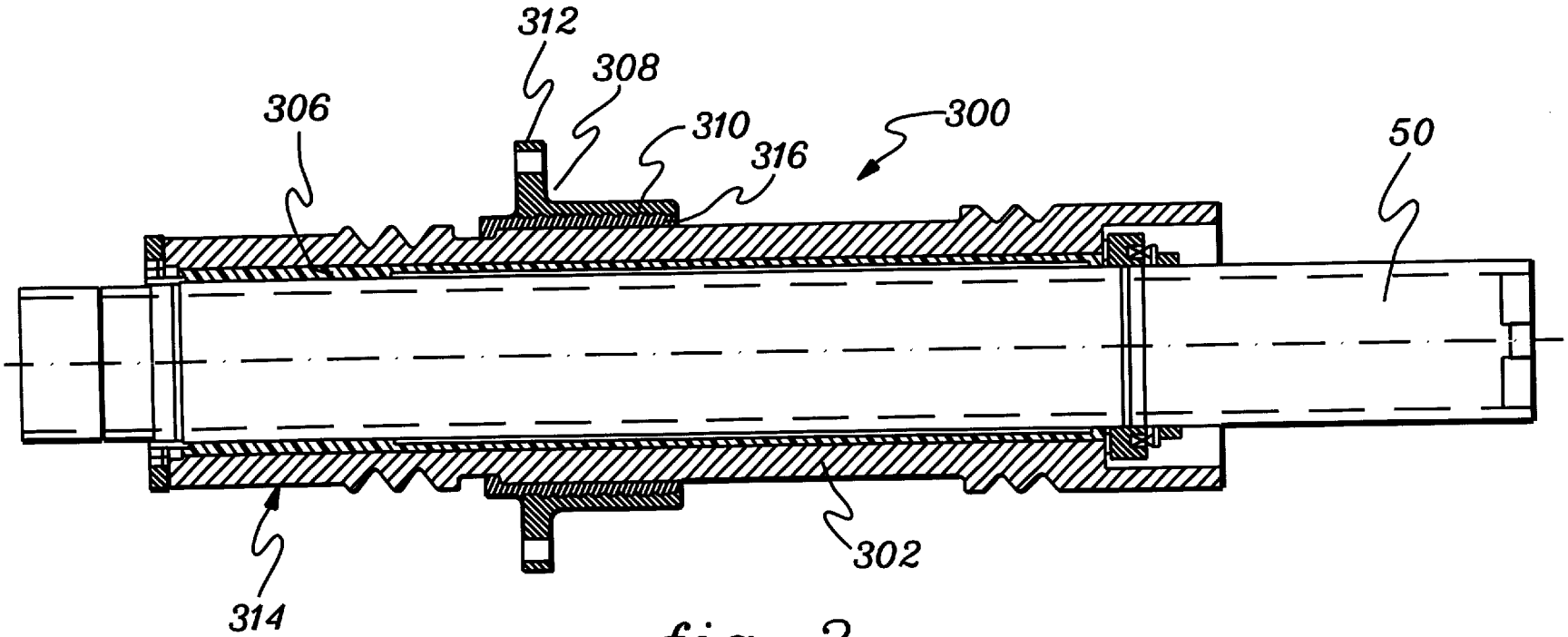
fig. 3 PRIOR ART
FIG. 3 depicts a cross-sectional view of a conventional high voltage bushing.

With reference to FIG. 3, a conventional high voltage bushings 300 is shown having a porcelain insulator 302 enclosing a conductor 50. A layer of asphalt 306 is used to provide heat transfer from the conductor 50 out to the porcelain tube or sleeve 302 and then to the surrounding hydrogen and air-cooling mediums. Asphalt 306 used in conventional bushings typically melts at approximately fifty to sixty degrees Celsius.

A mounting flange 308 is telescoped over porcelain insulator 302 and is used to secure porcelain insulator 302 to a pressure vessel wall (not shown). Mounting flange 308 has an axial portion 310 and a radial flange portion 312. Axial portion 310 is secured to outer cylindrical surface 314 of porcelain insulator 302 by an epoxy or adhesive layer 316, between axial portion 310 of mounting flange 308 and insulator 302. Mounting flange 308 is used to secure the bushing to the pressure vessel wall and to prevent hydrogen gas inside the generator from escaping out to the atmosphere, which could potentially cause an explosion.

The materials used to construct conventional bushings 300 have significant drawbacks. Specifically, porcelain used to make insulator 302 is brittle and can crack or break easily, reducing the materials dielectric strength and rendering the bushing unfit for service. In addition, conventional bushings rely on a lower temperature asphalt material to relieve internal pressures during excessive heating excursions caused by generator temperature incidents. Cracks forming in the porcelain insulators may result in the asphalt or hydrogen leaking out of the bushing and dangerously mixing with the atmosphere.

The assembly process is another disadvantage of conventional bushings. In particular, installing mounting flange 308 onto porcelain insulator 302 requires an elaborate and time consuming process requiring the proper alignment and positioning of mounting flange on porcelain insulator. In order to secure mounting flange 308 to porcelain insulator 302, an epoxy resin is used, which requires an intricate dam process to prevent the resin from escaping from between mounting flange 308 and porcelain insulator 302 and running down insulator 302. There is also no way to easily replace a faulty bushing, thus requiring a complete shut down of the generator and disassembly of the bushing box in order to replace a bushing. Therefore, conventional assembly procedures are expensive and highly undesirable.

Figure 1:
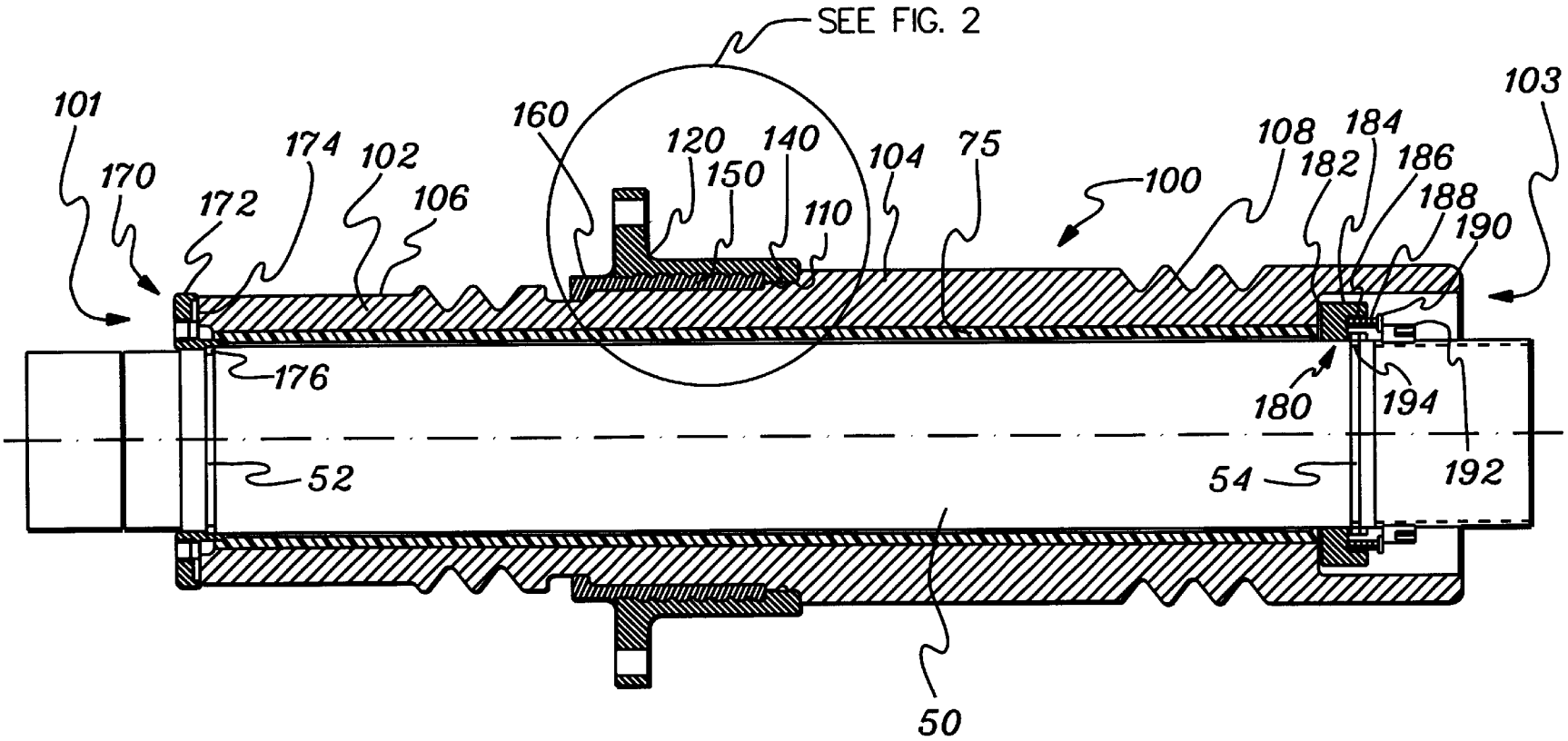
FIG. 1 depicts a cross-sectional view of a high voltage bushing constructed in accordance with the principles of the present invention.

In the illustrative embodiment shown in FIG. 1, a high voltage bushing 100 encloses a copper conductor 50 having a layer of asphalt or similar material 75 therebetween. Bushing 100 comprises an insulator 102 and a mounting flange 120 slid over insulator 102, in accordance with the principles of the present invention, for securing insulator 102 to a pressure vessel wall (not shown).

Asphalt layer 75 is intended to relieve internal pressure during excessive heating excursions caused by changing generator temperatures, which occur frequently. The asphalt material of the present invention is intended to sustain higher temperatures than the asphalt material used in conventional bushings. Asphalt 75 used in accordance with the principles of the present invention will melt at a temperature of approximately 230 to 245 degrees Fahrenheit, which permits the generator to run at higher temperatures before the asphalt material liquefies and escapes more easily. Asphalt may be, for example, ASTM D 312 Type IV asphalt. One suitable asphalt material is commercially available from GAF Building Materials Corp. (Wayne, N. J.).

Figure 2:
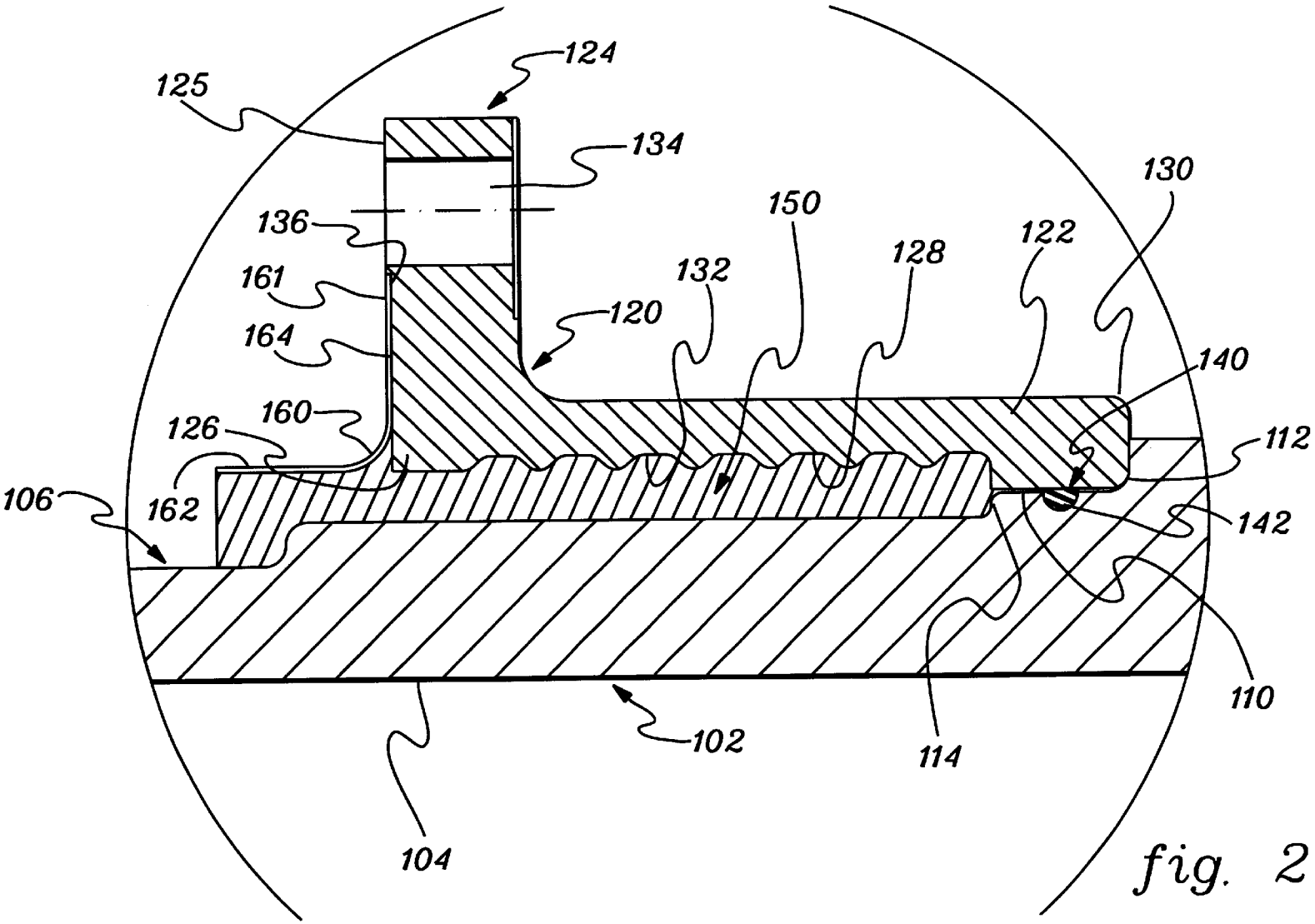
FIG. 2 depicts a fragmentary sectional view illustrating the flange seat and gasket of FIG. 1 for a high voltage bushing in accordance with the principles of the present invention.

Insulator 102 comprises an insulator sleeve or tube 104 having an outer cylindrical surface 106. Outer cylindrical surface 106 includes a plurality of ribs or flutes 108 extending radially outwardly. These ribs or flutes 108 increase the surface area of insulator tube 102 to increase the length of travel of electricity along outer cylindrical surface 106, while the overall length of the tube 104 is limited by design constraints. Insulator 102 also includes a flange seat 110 formed by, for example, the portion of outer cylindrical surface 106 between two shoulders 112, 114, which, in the embodiment shown in FIGS. 1 and 2, increase the thickness of insulator tube 104 at least twice.

Insulator 102 may be made from a composite material which provides improved resistance to impact damage and resilience to cracking, lower power factor, increased dielectric characteristics and lower probability of cracking or fracture due to thermal changes than the porcelain material currently used in conventional high voltage bushing. The composite material should also have high flexural and compressive strength, high tracking resistance and high deflection temperature. The composite may be cast from, for example, a silica filled, cycloaliphatic resin system. One suitable composite material is commercially available from CK Composites (Mount Pleasant, Pa.).

Mounting flange 120 includes an axial portion 122 and a radial flange portion 124 located at end 126 of axial portion 122. Axial portion 122 includes an inner surface 128 facing the outer cylindrical surface 106 of insulator tube 104. A portion of end 130 of axial portion 122 directly engages insulator tube 104 at shoulder 112 of flange seat 110. The remaining portion of inner surface 128 extending from shoulder 114 to end 126 of mounting flange 120 is secured to insulator tube 104 by means of an adhesive or epoxy layer 150. This remaining portion of inner surface 128 may include a plurality of grooves 132 formed in inner surface 128 for increasing the surface area receiving epoxy 150 and for providing recesses for epoxy to set therein in order to prevent sliding of mounting flange 120 along cylindrical surface 106 of insulator 102. Radial flange portion 124 is provided with a plurality of axially oriented through holes 134 which enable bushing 100 to be secured to the pressure vessel wall by means of, for example, bolts (not shown).

A gasket 140 is slid over outer cylindrical surface 106 of insulator tube 104 to a location on flange seat 110 formed between shoulders 112, 114. Gasket 140 is adapted to be compressed between the portion of inner surface 128 near end 130 of axial portion 122 of mounting flange 120 and flange seat 110 of insulator tube 104. Gasket 140 may be a rubber o-ring positioned in a mating recess or groove 142 formed in flange seat 110 of insulator tube 104 30 that it is compressed between axial portion 122 of mounting flange 120 and insulator tube 104. Gasket 140 serves as a gas tight seal preventing escape of hydrogen from inside the pressure vessel where mounting flange 120 is joined to the pressure vessel wall.

In an alternate embodiment of the high voltage bushing of the present invention, a gasket may be positioned at any location between the mounting flange and the outer surface of the insulator illustrated in, for example, FIG. 3, to create a gas tight seal. For example, the gasket may fit into one of grooves 132 formed in the surface 128 of the mounting flange facing the insulator. In this embodiment, the gasket serves as a seal between the mounting flange and the insulator to prevent the escape of hydrogen from between the mounting flange and the insulator without the need for a flange seat. The gasket may also serve as a dam during the assembly of the bushing for the insertion of the adhesive or epoxy layer used to secure the mounting flange to the insulator, as will be discussed in more detail below.

Turning back to FIGS. 1 and 2, a flux shield 160 is located so as to engage or abut radial portion 124 of mounting flange 120 in a "back-to-back" relationship on exposed side 125 of mounting flange 120 attached to the pressure vessel wall. Flux shield 160 includes an axial portion 162 secured to insulator tube 104 by, for example, epoxy layer 150, and a radial portion 164 positioned in a mating recess 136 formed in radial portion 124 of mounting flange 120. Mating recess 136 formed in radial portion 124 of mounting flange 120 ensures that the exposed surface 161 of flux shield 160 is flush with exposed surface 125 of radial portion 124 of mounting flange 120. Radial portion 164 is secured in place by, for example, bolts or, alternatively, soldering or an adhesive.

Flux shield 160 is intended to dissipate or ground miscellaneous current from an electromagnetic coil (not shown) that surrounds bushing 100. Flux shield 160 may also serve as an additional seal preventing escape of hydrogen from inside the pressure vessel where mounting flange is joined to the pressure vessel wall. A gasket (not shown) may extend over exposed side 161 of the flux shield 160 and exposed side 125 of radial portion 124 and is adapted to be compressed between flux shield 160 and radial portion 124 of mounting flange 120 and the pressure vessel wall when bushing 100 is secured to the pressure vessel wall by the bolts. The gasket may be an o-ring positioned in a mating recess in the pressure vessel wall so that it is compressed between flux shield 160 and radial portion 124 of mounting flange 120 and the pressure vessel wall.

Bushing 100 may also include seals 170, 180 located at ends 101, 103, respectively, of insulator 102. In one embodiment, seal 170 includes a top retainer 172 compressing a top retaining gasket 174 against end 101 of insulator 102 to prevent hydrogen and asphalt from leaking between insulator 102 and asphalt layer 75. An o-ring 176 may be positioned in a groove 52 formed in conductor 50 so that it is compressed between conductor 50 and top retainer 172 to prevent hydrogen and asphalt from escaping between conductor 50 and asphalt layer 75.

In one embodiment, seal 180 includes a spring retaining gasket 182 compressed between end 103 of insulator 102 and a spring retainer 184 to prevent hydrogen and asphalt from leaking between insulator 102 and asphalt layer 75. Spring retainer 184 includes a groove 186 for housing or supporting one end of a compression spring 188. The other end of compression spring 188 is anchored or supported against a spring retainer washer 190 which is limited from moving in one direction along conductor 50 by locknut 192. In operation, spring retainer gasket 182 will maintain pressure at end 104 by compression spring 188 as conductor 50 and porcelain insulator 102 expand and contract as a result of exposure to changing temperatures. An o-ring 194 may be positioned in a groove 54 formed in conductor 50 so that it is compressed between conductor 50 and spring retainer 184 to prevent hydrogen and asphalt from escaping between conductor 50 and asphalt layer 75.

One method of assembling bushing 100 will now be described. In this method, a sleeve made from, for example, a glass reinforced epoxy, is slipped over and centered on conductor 50. Seal 170 is then installed on conductor 50. During the installation of seal 170, o-ring 176 is slid into groove 52 of conductor 50. Top retainer gasket 174 is positioned onto top retainer 172 which are together slid over conductor 50 so that gasket 174 faces in a direction to eventually contact end 101 of insulator 102. Top retainer 172 may be held in place on conductor 50 by, for example, mating threads or the like.

Conductor 50 with seal 170 attached may then installed into an assembly or holding fixture with the end of conductor 50 supporting seal 170 inserted first. The assembly fixture may be any supporting structure used to aid in centering and holding the components of the bushing during assembly. After conductor 50 is installed in the assembly fixture, insulator 102 is prepared by sliding gasket 140 over insulator 102 until it rests in groove 142 formed in flange seat 110 of outer surface 106 of insulator tube 104.

Mounting flange 120 may be installed in the assembly fixture before insulator 102. Radial portion 124 of mounting flange 120 is positioned on the assembly fixture such that through holes 134 align with the corresponding holes formed in the assembly fixture of the assembly fixture. After alignment, mounting flange 120 is bolted to the pressure vessel wall by, for example, threaded members such as bolts.

Next, insulator 102 is installed over conductor 50 and into mounting flange 120 with end 101 inserted first until end 101 abuts against top retainer gasket 174 of seal 170 and flange seat 110, in particular shoulder 112 of insulator 102, contacts end 130 of mounting flange 120. Flange seat 110 provides for quick flange installation, accurate flange alignment on insulator tube and reduced construction time of bushing 100. Insulator 102 is centered and locked into place by, for example wedging.

After insulator 102 is installed, seal 180 is installed onto conductor 50. During the installation of seal 180, o-ring 194 is positioned in groove 54 of conductor 50. Spring retainer gasket 182 is next slid onto conductor 50 against end 101 (e.g on an inner shoulder formed at end 101) of insulator 102. Spring retainer 184 is then installed over conductor 50 until spring retainer 184 is against spring retainer gasket 182. One end of compression spring 188 is placed in groove 186 formed in spring retainer 184 while spring retainer washer 190 is slide over conductor 50 and positioned against the other end of compression spring 188. Finally, lock nut 192 is threaded onto conductor 50 and a torque of about 600 foot pounds is applied to secure insulator 102 in place on conductor 50.

Next, bushing 100 is removed from the assembly fixture (e.g. unbolting mounting flange 120) and rotated 180 degrees so that the gap or space formed between axial portion 122 of mounting flange 120 and insulator 102 can receive the epoxy material.

Flux shield 160 is then slipped over end 101 of insulator 102 until radial portion 164 of flux shield 160 is positioned in groove 136 formed in radial portion of mounting flange 120. Flux shield 160 is then attached by, for example, bolts to mounting flange 120.

An epoxy, such as, for example, a two part 3060 epoxy mix, is applied between axial portion 122 of mounting flange 120 and outer cylindrical surface 106 of insulator 102. Curing time for the epoxy is approximately 24 hours. With flange seat 110 and gasket 140 constructed in accordance with the principles of the present invention, there is no need to create a dam for the epoxy material as was required during the assembly of conventional bushings. The seal created by flange seat 110 and gasket 140, or alternatively, just a rubberized gasket positioned between mounting flange 120 and insulator 102, prevents the epoxy material from escaping down along outer cylindrical surface 106 past shoulders 112 and/or 114.

Next, the bushing is heated to approximately 110 degrees Celsius and the asphalt is heated to approximately 240 degrees Celsius. The asphalt is poured between conductor 50 and insulator 102, using, for example, a ladle, to within one inch from the top of insulator tube 104. The asphalt is permitted to sit for at least an hour after which the asphalt level is checked to make sure that it does not fall below the one inch level. If the level of asphalt falls below the one inch level, the asphalt is repoured to the one inch level and allowed to cool overnight.

A locktite may be applied on the threads and two pipe plugs may be installed in top retainer 172. A pressure canister may also be installed over bushing 100 and bolted into place.

Approximately ninety psi of pressure is then applied to bushing 100 for about 20 minutes. No drop in pressure is permitted. A DC hi-potential test at approximately 68,000 volts for about one minute may also be performed. This test is a pass/fail test.

Insulator 102 may then be sprayed from the bottom of mounting flange 120 to the first skirt on insulator 102. A ground strap is soldered from a copper coated area to mounting flange 120. Conductor 50 and gasket surface area are masked and bushing 100 is painted and both ends of conductor 50 are prepped and silver plating is applied thereto.

Although preferred embodiments have been depicted and described in detail herein, it will be apparent to those skilled in the relevant art that various modifications, additions, substitutions and the like can be made without departing from the spirit of the invention and these are therefore considered to be within the scope of the invention as defined in the following claims.

What is claimed is:

1. A high voltage bushing, said bushing comprising:

an insulator adapted to fit over a conductor, said insulator including an outer surface defining a flange seat;

a mounting flange mounted over the insulator, said mounting flange including an axial portion and a radial portion located at one end of the axial portion, the axial portion positioned on the flange seat of said insulator at an end opposite of the radial portion, the remaining portion of the axial portion joining said insulator by an adhesive layer.

2. The bushing of claim 1, further comprising a gasket positioned between the flange seat of said insulator and the axial portion of said mounting flange positioned on the flange seat.

3. The bushing of claim 1, wherein said insulator is made from a silica filled, cycloaliphatic resin.

4. The bushing of claim 1, wherein an asphalt layer is positioned between the conductor and said insulator.

5. The bushing of claim 4, wherein said asphalt layer is an ASTM D 312 Type IV asphalt.

6. The bushing of claim 1, wherein the flange seat is a portion of the outer surface of the insulator between two shoulders formed in said insulator.

7. The bushing of claim 6, wherein the thickness of the insulator is increased at the two shoulders formed in the insulator.

8. A high voltage bushing, said bushing comprising:

an insulator adapted to fit over a conductor;

a mounting flange mounted over the insulator, said mounting flange including an axial portion and a radial portion located at one end of the axial portion;

a gasket positioned between the insulator and the axial portion of the mounting flange at an end opposite the radial portion; and an adhesive layer between the insulator and the axial portion of the mounting flange and extending from the gasket to at least the end at which the radial portion is located.

9. The bushing of claim 8, wherein the insulator includes a first shoulder and a second shoulder, wherein the gasket is positioned between the first and second shoulders.

10. The bushing of claim 9, wherein a flange seat is defined between the first and second shoulders.

11. The bushing of claim 10, wherein the insulator has different diameters before the first shoulder, between the first and second shoulders and after the second shoulder.

12. A high voltage bushing, said bushing comprising:

an insulator adapted to fit over a conductor, said insulator including an outer surface;

a mounting flange mounted over the insulator, said mounting flange including an axial portion facing the outer surface of the insulator and a radial portion located at one end of the axial portion; and a gasket positioned between the axial portion of said mounting flange and the outer surface of said insulator.

13. The bushing of claim 12, wherein the gasket is a rubberized o-ring.

14. The bushing of claim 12, wherein said insulator and said mounting flange are held together by an adhesive layer between the outer surface of said insulator and the axial portion of said mounting flange.

15. A method of assembling a high voltage bushing, said method comprising:

providing an insulator, the insulator having an outer surface and defining a flange seat;

providing a mounting flange, the mounting flange including an axial portion and a radial portion located at one end of the axial portion;

positioning a gasket on the flange seat of the insulator;

sliding the mounting flange onto the insulator until an end of the axial portion opposite the radial portion is positioned in the flange seat of the insulator and over the gasket;

inserting an adhesive between the mounting flange and insulator to connect the mounting flange to the insulator while using the gasket as a dam to prevent leakage of the adhesive.

16. A method of assembling a high voltage bushing, said method comprising:

providing an insulator, the insulator having an outer surface;

providing a mounting flange, the mounting flange including an axial portion and a radial portion located at one end of the axial portion;

positioning a gasket on the outer surface of the insulator;

sliding the mounting flange onto the insulator until the gasket is positioned between the mounting flange and the insulator;

inserting an adhesive between the mounting flange and insulator to connect the mounting flange to the insulator while using the gasket as a dam to prevent leakage of the adhesive.

* * * * *